US005465541A

United States Patent [19]

Lin et al.

[11] Patent Number: 5,465,541

[45] Date of Patent: Nov. 14, 1995

[54] BUILDING CONSTRUCTION OF LONGITUDINAL AND CROSS HOLLOW COMPONENTS

[76] Inventors: Yi-Chung Lin, No. 35-3, Lane 301, Fu Mei Rd.; Wen-Tien Wu, No. 6, Lane 534, Lien Cheng Rd., both of Chungho City, Taiwan

[21] Appl. No.: 207,696

[22] Filed: Mar. 9, 1994

[51] Int. Cl.[6] ..... E04F 17/08

[52] U.S. Cl. ..... 52/220.2; 52/220.3; 52/592.4; 52/607

[58] Field of Search ..... 52/220.2, 220.3, 52/220.7, 592.4, 592.5, 439, 607, 606

[56] References Cited

U.S. PATENT DOCUMENTS

| | | | |
|---|---|---|---|
| 960,217 | 5/1910 | Dodds | 52/439 X |
| 996,040 | 6/1911 | Meier | 52/607 X |
| 1,171,191 | 2/1916 | Gronert et al. | 52/439 X |
| 1,216,550 | 2/1917 | Ciciliani | 52/592.4 |
| 1,254,109 | 1/1918 | Atterbury | 52/220.2 X |
| 1,282,090 | 10/1918 | Lemme | 52/592.4 |
| 1,539,611 | 5/1925 | Trowbridge | 52/607 |
| 1,582,735 | 4/1926 | Cooper | 52/607 |
| 1,981,324 | 11/1934 | Peterson | 52/220.2 X |
| 2,947,040 | 8/1960 | Schultz | 52/592.4 |
| 3,000,144 | 9/1961 | Kitson | 52/607 |
| 3,908,323 | 9/1975 | Stout | 52/220.2 X |
| 4,237,670 | 12/1980 | De Waele | 52/439 X |
| 4,567,699 | 2/1986 | McClellan | 52/220.3 X |
| 4,769,961 | 9/1988 | Gillet | 52/592.4 X |
| 4,856,238 | 8/1989 | Kesting | 52/220.2 X |
| 5,035,100 | 7/1991 | Sachs | 52/607 X |

FOREIGN PATENT DOCUMENTS

| | | | |
|---|---|---|---|
| 515226 | 3/1921 | France | 52/439 |
| 698174 | 1/1931 | France | 52/606 |
| 2238819 | 2/1975 | France | 52/607 |
| 2142038 | 3/1973 | Germany | 52/592.5 |
| 30162 | 1/1911 | Sweden | 52/607 |
| 13092 | 1/1897 | Switzerland | 52/437 |
| 143749 | 6/1920 | United Kingdom | 52/607 |
| 1076748 | 7/1967 | United Kingdom | 52/592.5 |

*Primary Examiner*—Carl D. Friedman
*Assistant Examiner*—Laura A. Saladino
*Attorney, Agent, or Firm*—Bacon & Thomas

[57] ABSTRACT

A building construction of longitudinal and cross hollow components includes building unit bodies each of which consists of joggles, scarfs, extension paths and wiring holes, such that, after a plurality of such unit bodies are formed into a wall, it forms transverse penetrating wiring paths with a gradient and longitudinal paths to assure convenient wiring construction. It also has the advantages of fire-proofing, heat discharging, and prolongation of rescue time when the building is on fire.

4 Claims, 7 Drawing Sheets

BUILDING CONSTRUCTION OF LONGITUDINAL AND CROSS HOLLOW COMPONENTS

BACKGROUND OF THE INVENTION

This invention is about a convenient construction for installing pipe-wiring in a building. Especially, it relates to a building component with longitudinal and hollow extension paths inside and cross wiring holes to make it heat proof, heat discharging, preventing the shake of earthquake, avoiding annoying sound, and providing hidden wiring construction.

The conventional architectural wiring construction method is to knock off a certain depth of the wall for wiring grooves after the wall and the floor are finished, and then bury the wiring tubes in them. However, this kind of construction method has the limit that it can only be carried out after the wall is formed. It will somewhat affect the working hours, working progress, and the structural strength of the wall. Nowadays, due to the new invention of beam welding and various new engineering methods, it is possible to bury the tubes in a precast body in advance. Yet, because of the solid structure of the wall, by using the above-mentioned methods, the heat proofing is not enough if the formed building is on fire. In order to overcome this problem, there are more and more constructive materials of fire-fighting and fire-proof equipment invented. However, such structure for constructive convenience, changeability, even fire and heat proof, heat discharging in order to prolong the time for rescue, they all need a large amount of money. It is a realistic problem to overcome.

For all the disadvantages of the conventional building structures and construction methods, the inventor has an invention to improve them at last.

SUMMARY OF THE INVENTION

Therefore, this invention aims to provide a vertical structure with a longitudinal extension path and cross wiring holes, in the form of a wall or floor formed by a plurality of unit bodies, having a hidden-wiring construction through hollow sections. Such a structure can reduce working hours and increase the changeability of multiplex construction. This is the main purpose of this invention. According to the present construction of the longitudinal and cross hollow components, the extension paths and wiring holes thereof are mutually connected. The cross arrangement between left side and right side wiring holes are in the form of cross-alternation which causes a gradient between each corresponding left wiring hole and right wiring hole. In this way, it is convenient for wiring, and also has the connective effect for fire-proofing, and smoke and heat discharging, which is another purpose of this invention. In order to achieve the above mentioned purposes, this invention takes advantage of the arrangement of left and right wiring holes with cross-alternation disposition, the extension paths of longitudinal penetration, and joggle and scarf design on two sides to form a unit body component, and to assemble a wall or floor by way of a combination of the unit bodies. By offering a variety of inserting ways between wiring holes and extension paths, it is able to adjust the cross or longitudinal penetrating wiring. The hollow structure also has the effect of fire proofing, smoke and heat discharging, and avoidance of annoying sounds.

For more detailed structures, applied theories, functions and effects, please refer to the appended drawings and detailed description hereinafter for full understanding.

DETAILED DESCRIPTION OF THE PREFERRED EMBODIMENTS

Figure 1:
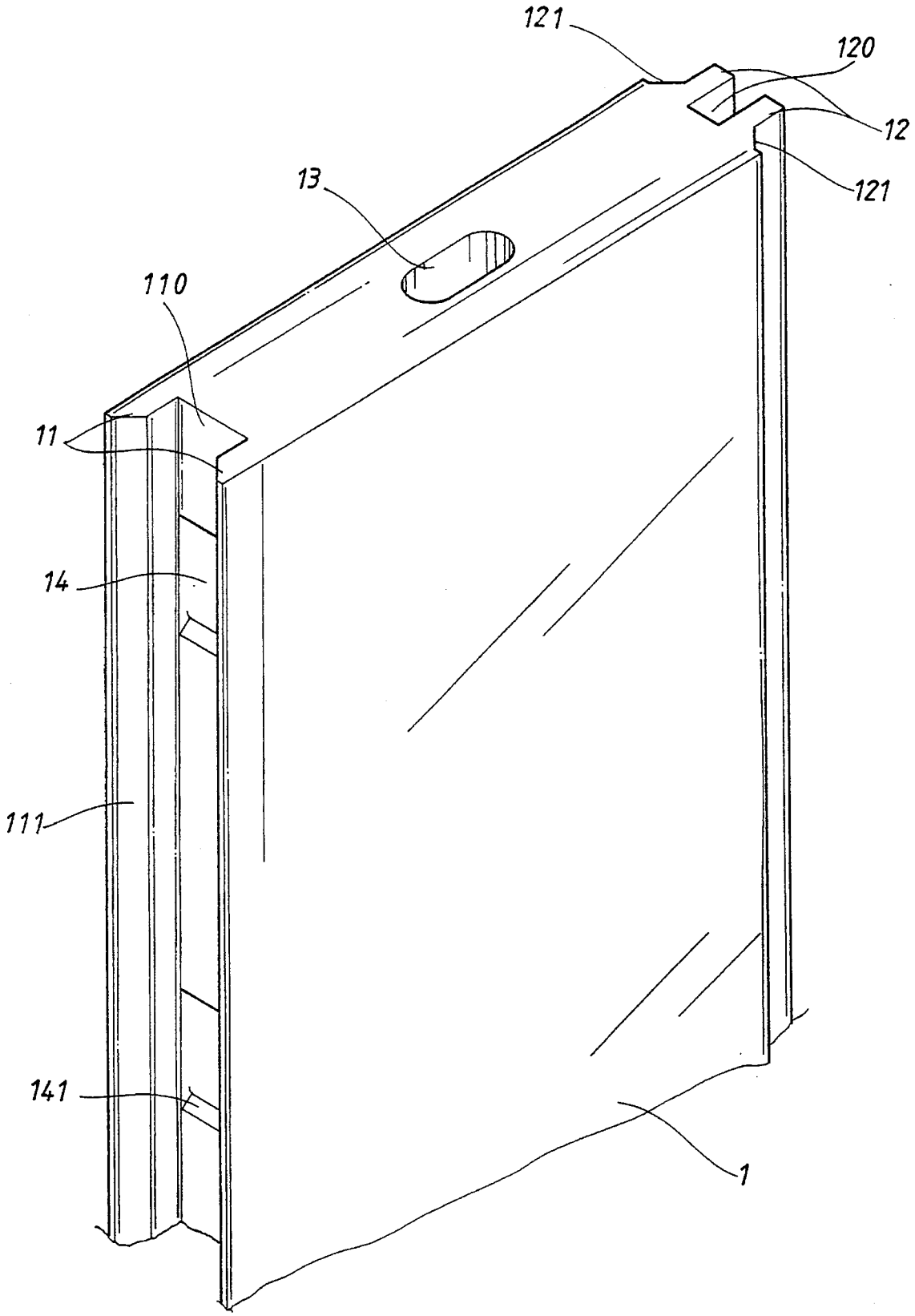
FIG. 1 is a perspective view of a building unit according to the invention.
Figure 2:
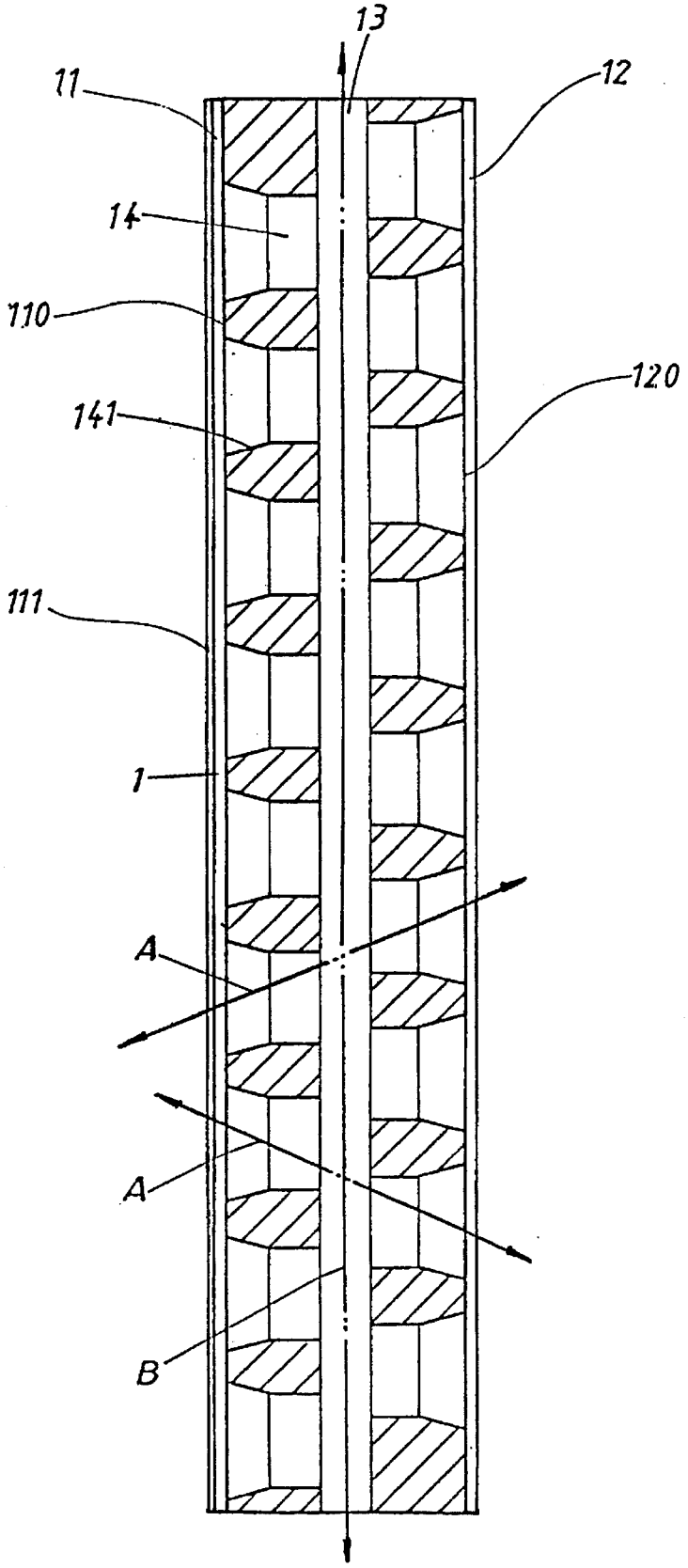
FIG. 2 is a cross sectional view of the building unit according to the invention.
Figure 3:
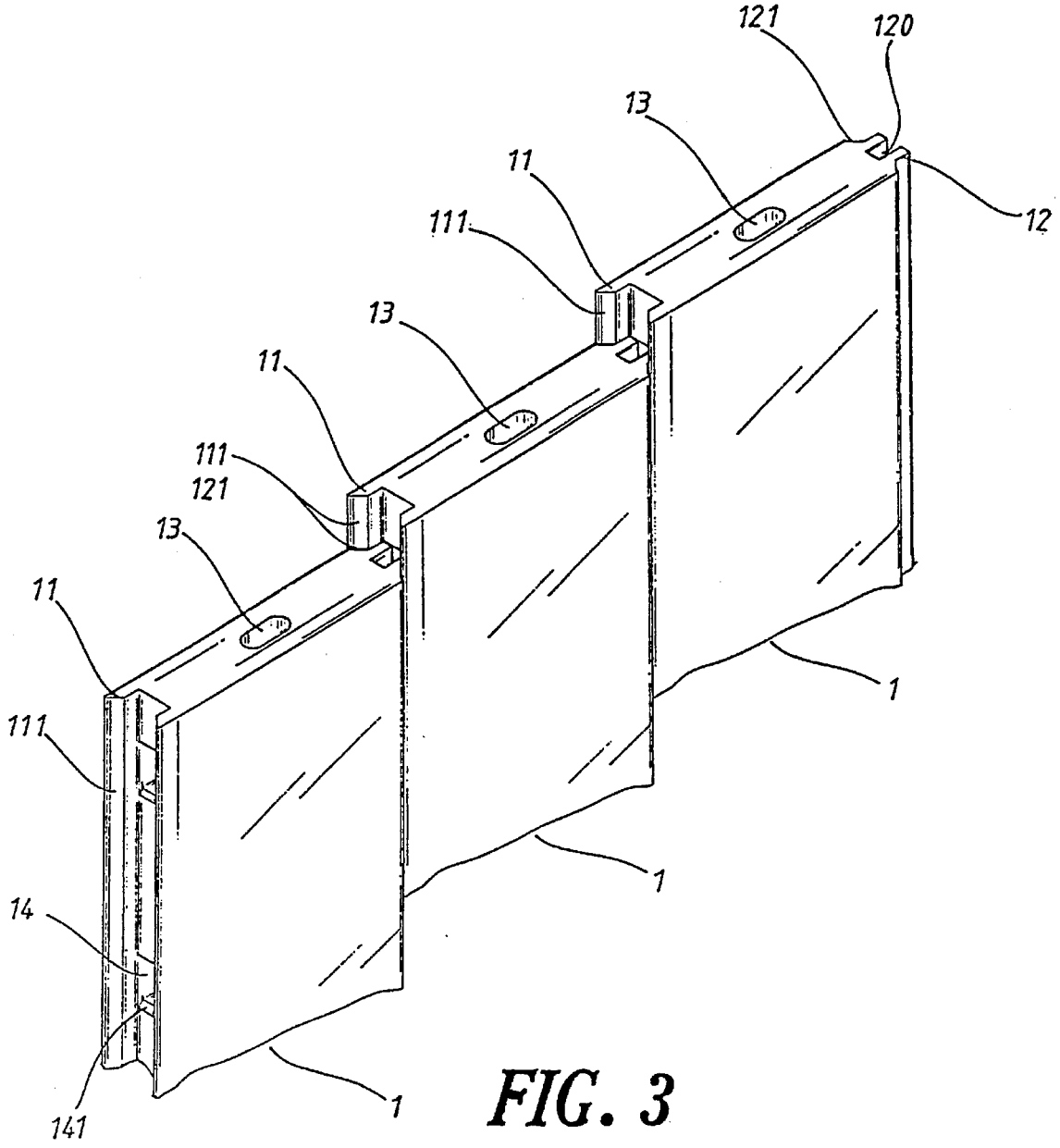
FIG. 3 is a perspective view showing an example of a combination of multiple units according to the invention.
Figure 4:
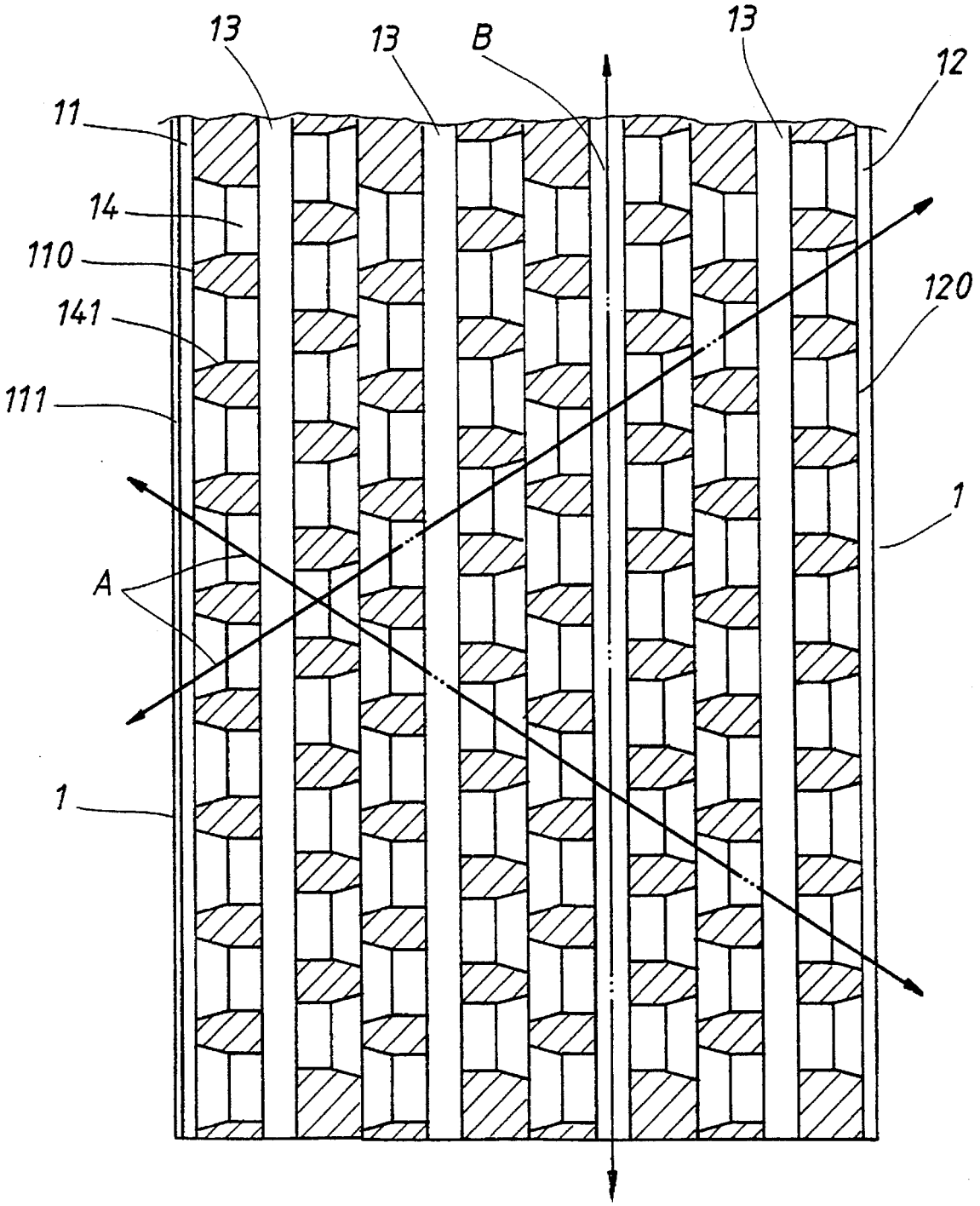
FIG. 4 is a cross sectional view of the combination of multiple units according to the invention.

Please refer to FIG. 1 and FIG. 2, the structure of this invention consists of building unit bodies of specified length, width, and height in order to form a wall (FIG. 3). On one side of the unit body (1) extending along its height, there are joggles (11 ). Between the joggles (11), there is a formed "U"-shaped retaining groove (110). Connecting the vertical surfaces of the joggle (11) and of the retaining groove (110) is an oblique face called the joggle face (111). Along the retaining groove (110), the unit body (1) has penetrating wiring holes (14) through bilateral sides. Ends of the wiring holes have oblique leading edges (141) and are vertical to the longitudinal path (13). They form a cross path in the inside of the unit body (1) or a wall formed with combined unit bodies (FIGS. 2, 4). On the other side of the unit body (1), there are scarfs (12). Disposed between external surfaces of scarfs (12) and the unit body along its height are scarfing faces (121). Between two scarfs (12), there is a "U"-shaped retaining concave (120). On the interface between the scarfs (12) vertical face and the retaining concave (120), there are also penetrating wiring holes (14) which pass through the longitudinal path (13). As shown in FIG. 2, the wiring holes (14) on left retaining groove (110) and on right retaining concave (120) are mutually connected, and form transverse penetrating lines (A) with a gradient on two sides of the longitudinal path (13). The left wiring holes opening into retaining groove (110), and the right wiring holes opening into retaining concave (120) are disposed in a cross-alternation pattern. It is beneficial for the wiring construction after all unit bodies are assembled (see FIG. 4).

Please refer to FIG. 3. The scarf (12) is inserted into the joggle (11) when assembling the building units such that the joggling face (111) fits tightly against the scarfing face (121). After such combination, correspondent cross wiring holes (14) present a transverse penetrating line (A) as shown in FIG. 4, and each longitudinal path (13) forms a longitudinal penetrating line (B). (These penetrating lines (B) cross through the longitudinal paths (13) of each unit body.) According to this method, after assembling, the penetrating lines extend both in longitudinal and cross directions. It is a good structure for the wiring construction after the wall or floor is finished.

Figure 5:
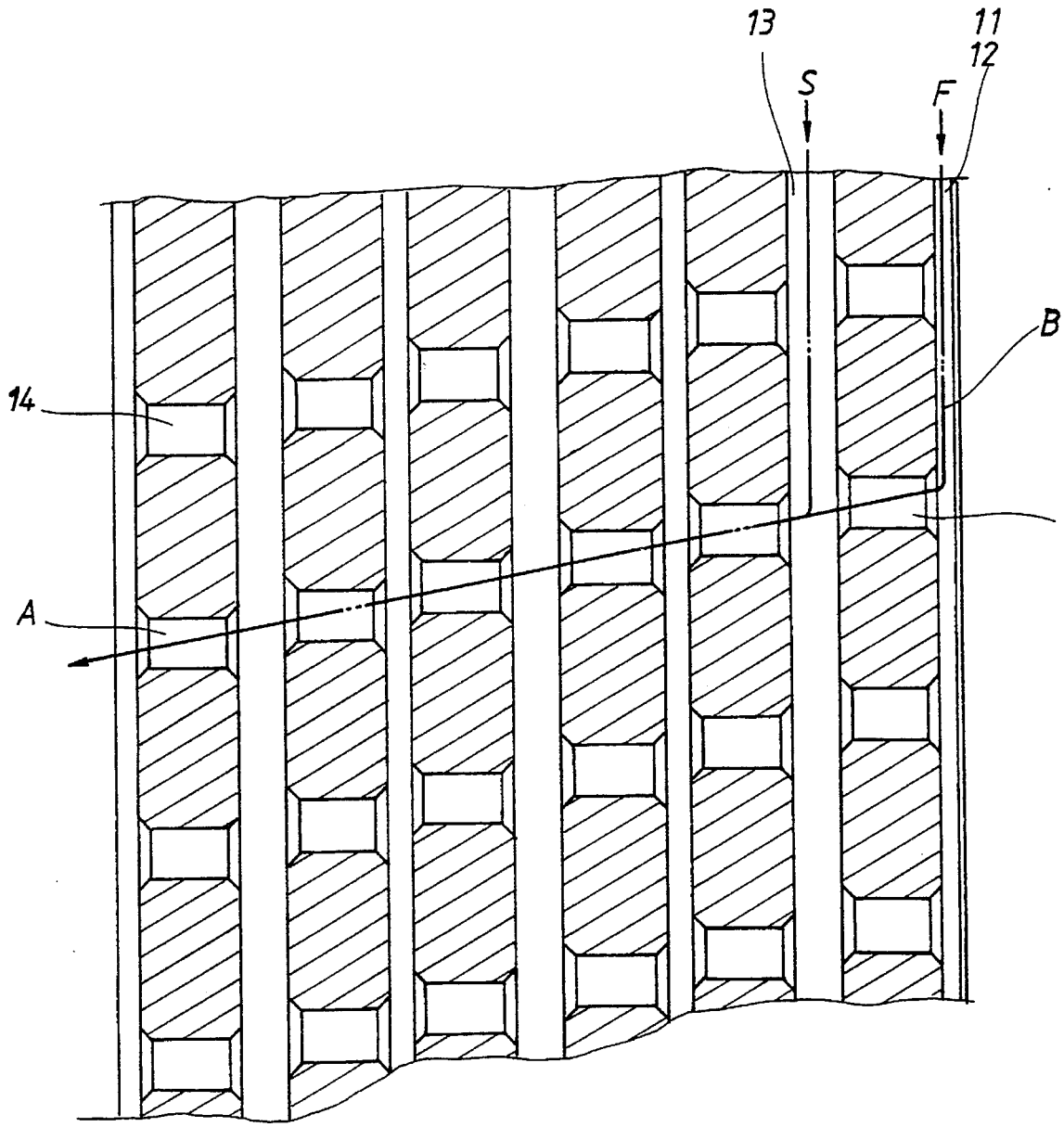
FIG. 5 is a diagrammatical cross-sectional view of the wiring construction method of an embodiment according to the invention.
Figure 6:
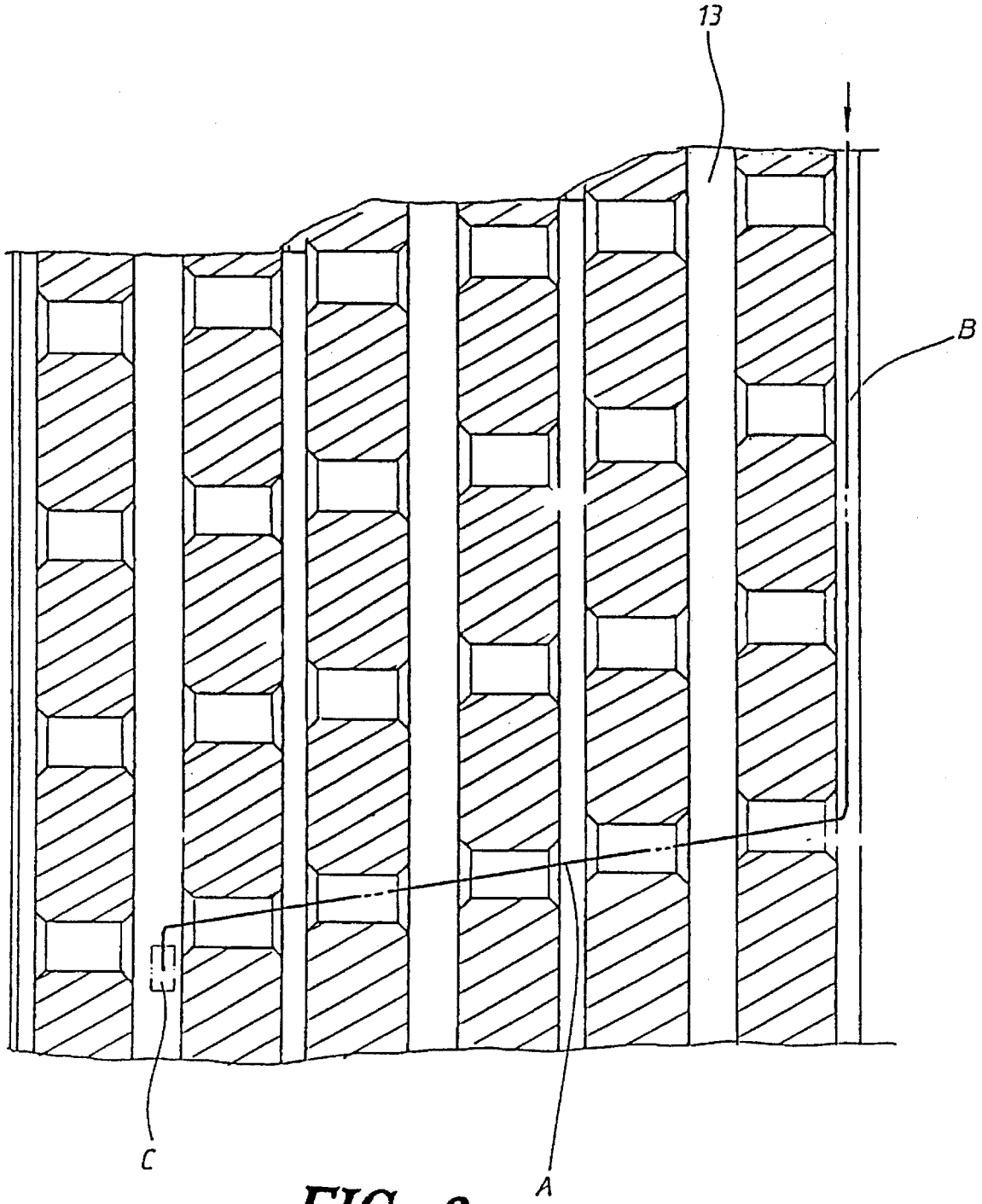
FIG. 6 is a diagrammatical cross-sectional view of the wiring construction method of another embodiment according to the invention.
Figure 7:
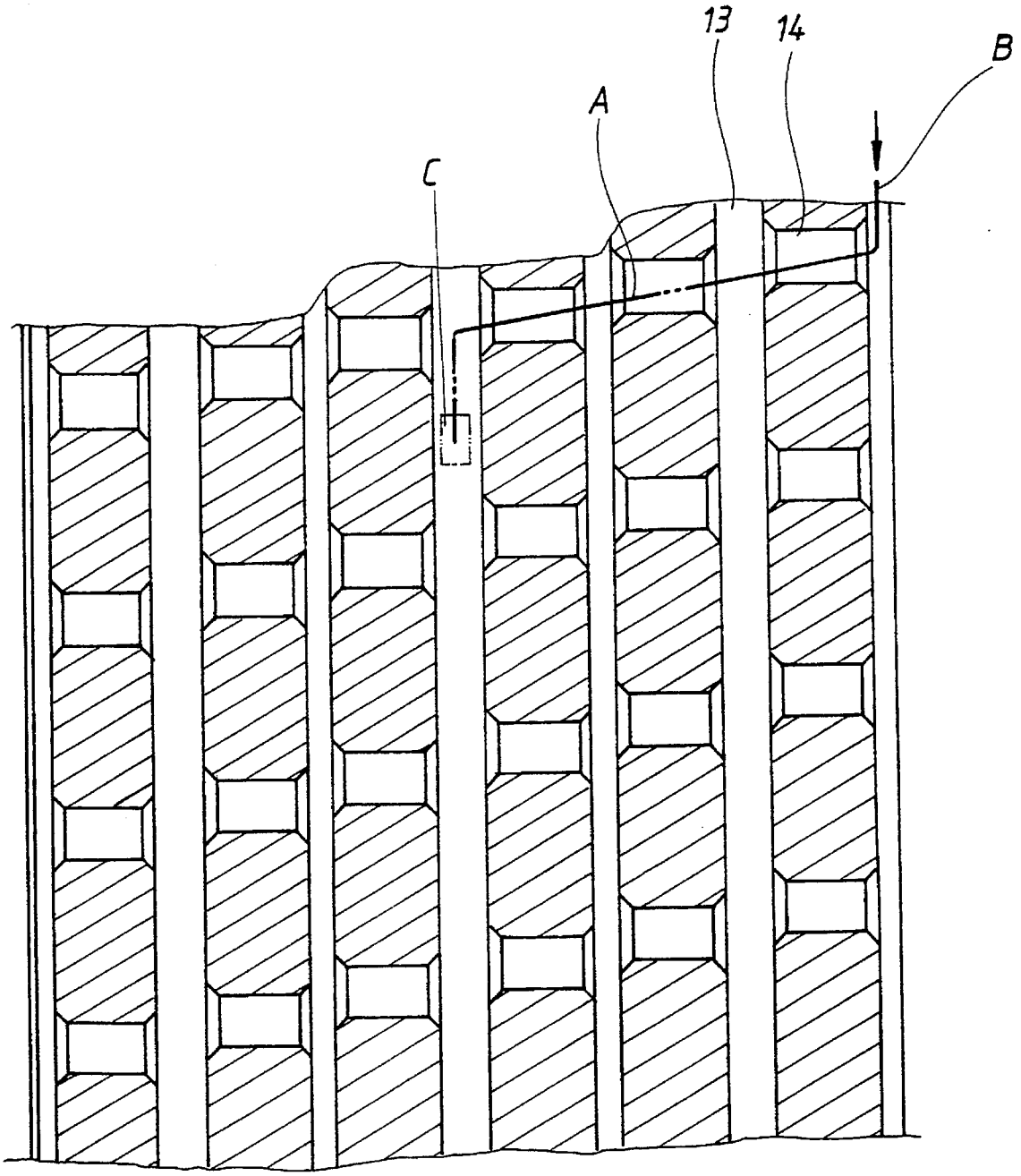
FIG. 7 is a diagrammatical cross-sectional view of the wiring construction method of a further embodiment according to the invention.

Please refer to FIG. 5. After a wall or floor is assembled, electric wiring can follow the straight path (F) between joggles (11) and scarfs (12), or follow the straight path (S) in longitudinal path (13) along the penetrating line (B), and then turn to the wiring holes (14) along the penetrating line (A). When a power receptacle (C) is located in a lower position (as shown in FIG. 6), the longitudinal penetrating line (B) should extend downward, and turn to wiring holes (14) along the transverse penetrating line (A) to connect to the power receptacle (C). If the power receptacle (C) is located in a higher position (As shown in FIG. 7), the longitudinal penetrating line (B) can be shortened, and turn to the transverse penetrating line (A) to connect to the power receptacle (C). This construction avoids knocking off the wall to bury wiring in it, and is easy to change the prearranged wiring if it does not fit. The hollow wiring holes (14) and the longitudinal paths (13) also form a safe and convenient structure for smoke and heat discharging, heat proofing, adjustment in horizontal and vertical directions, and hidden wiring construction.

The present invention has the advantages of heat proofing, smoke discharging, and great variability of construction which can improve the disadvantages of the conventional methods in building construction. The hollow structure of the inner wall according to the present invention has enough structural strength to avoid annoying sounds, to prevent the shaking by earthquake, to regulate room air-conditioning and save electric energy.

What is claimed is:

1. A building unit having opposite sides and opposite ends extending between the opposite sides and comprising;

a) at least one hollow longitudinal path extending between the opposite ends and located between the opposite sides;

b) joggles extending along one of the opposite sides defining a generally "U"-shaped groove therebetween;

c) scarfs extending along the other of the opposite sides and located so as to enter the "U"-shaped groove of an adjacent building unit, the scarfs defining a generally "U"-shaped concavity extending along the other of the opposite sides;

d) a plurality of first wiring holes extending between and communicating with the generally "U"-shaped groove and the at least one hollow longitudinal path; and, e) a plurality of second wiring holes extending between and communicating with the generally "U"-shaped concavity and the at least one hollow longitudinal path, the plurality of second wiring holes extending generally parallel to the plurality of first wiring holes, but displaced toward one of the opposite ends so as to be out of alignment with the plurality of first wiring holes, so as to form wiring paths through the building unit extending obliquely to the opposite sides.

2. The building unit of claim 1 wherein the generally "U"-shaped groove has opposite side surfaces and further comprising oblique joggle faces connecting each opposite side surface to a joggle.

3. The building unit of claim 1 further comprising oblique leading edges on the first wiring holes adjacent to the generally "U"-shaped groove.

4. The building unit of claim 3 further comprising oblique leading edges on the second wiring holes adjacent to the generally "U"-shaped concavity.

* * * * *